US010579091B2

(12) United States Patent
Mendoza

(10) Patent No.: US 10,579,091 B2
(45) Date of Patent: Mar. 3, 2020

(54) KNOB SAFETY INSERT

(71) Applicant: Jowie E. Mendoza, Banning, CA (US)

(72) Inventor: Jowie E. Mendoza, Banning, CA (US)

( * ) Notice: Subject to any disclaimer, the term of this patent is extended or adjusted under 35 U.S.C. 154(b) by 0 days.

(21) Appl. No.: 16/507,032

(22) Filed: Jul. 10, 2019

(65) Prior Publication Data

US 2019/0361482 A1 Nov. 28, 2019

Related U.S. Application Data

(63) Continuation of application No. 16/413,547, filed on May 15, 2019.

(60) Provisional application No. 62/666,294, filed on May 25, 2018.

(51) Int. Cl.
*G05G 5/06* (2006.01)

(52) U.S. Cl.
CPC ..... *G05G 5/06* (2013.01); *G05G 2505/00* (2013.01)

(58) Field of Classification Search
CPC .. F24C 7/08; F24C 7/082; F24C 7/086; F24C 15/36; G05G 1/02; G05G 1/08; G05G 1/082; G05G 1/10; G05G 5/005; G05G 5/02; G05G 5/04; G05G 5/06; G05G 2505/00; H01H 3/12; H01H 9/286; H01H 9/287; H01H 13/14; H01H 13/72; H01H 25/06

See application file for complete search history.

(56) References Cited

U.S. PATENT DOCUMENTS

| | | | | |
|---|---|---|---|---|
| 4,876,425 | A | 10/1989 | Woskow | |
| 5,278,365 | A | 1/1994 | Rowley et al. | |
| 5,324,897 | A | 6/1994 | Melgoza et al. | |
| 5,813,396 | A * | 9/1998 | Bessette | F24C 15/36 126/214 D |
| 5,931,150 | A | 8/1999 | Bowen et al. | |
| 7,963,003 | B1 | 6/2011 | Keene | |
| 8,434,199 | B1 | 5/2013 | Bowen et al. | |
| 9,110,491 | B2 | 8/2015 | May | |
| 9,684,329 | B2 | 6/2017 | Lawson | |
| 9,823,684 | B2 | 11/2017 | Finley et al. | |
| D805,842 | S | 12/2017 | Funnell, II et al. | |

(Continued)

OTHER PUBLICATIONS

"Silicone Rubber." Wikipedia page, Wayback Machine captured on Mar. 26, 2017.*

(Continued)

*Primary Examiner* — Richard W Ridley
*Assistant Examiner* — Brian J McGovern
(74) *Attorney, Agent, or Firm* — Chen Yoshimura LLP

(57) ABSTRACT

A removable knob safety insert is installed in a cooking device such as a gas or electric stove, between and the rear face of its control knob and the face of its control panel. The knob safety insert is designed to manually control the activation or deactivation of the cooking elements, as desired. The push-in-and-turn type switches used in such devices require that the control knob be pushed in before the switch can be moved from its off position. When in its locked position, the knob safety insert prevents the control knob from being pushed and thus the cooking element from being activated. When in its unlocked position, the knob safety insert enables the control knob to be pushed, allowing the cooking element to be moved from its off position.

8 Claims, 5 Drawing Sheets

(56) References Cited

U.S. PATENT DOCUMENTS

2012/0285288 A1* 11/2012 Chinigo ..... G05G 5/06 74/531
2018/0364817 A1* 12/2018 Ota ..... G06F 3/0362

OTHER PUBLICATIONS

"Stove Guard Oven Lock Child Safety Burner Knob Locks," Amazon Product Page, sold by Aukfa, url: <https://www.amazon.com/Heatproof-Anti-Break-Toddlers-Alzheimers-Universal/dp/B07WKL6BGW/ref=sr_1_1?keywords=aukfa&qid=1572982064&s=baby-products&sr=1-1>.*
"Vadiff Silicone Gas Stove Child Safety Knob Locks," Amazon Product Page, sold by Vadiff, url: <https://www.amazon.com/Vadiff-Silicone-Stove-Child-Safety/dp/B07HGKP64D/ref=sr_1_4?crid=12WCVIM52I4P3&keywords=vadiff%2Bsilicone%2Bgas%2Bstove%2Bchild%2Bsafety%2Bknob%2Blocks&qid=1572970411&s=baby-products&sprefix=vad%>.*
Email from Amazon Customer Service indicating product launch date of Vadiff Silicone Gas Stove Child Safety Knob Locks.*
"Vadiff Silicone Stove Knob Locks," Youtube page, url: <https://www.youtube.com/watch?v=utel_QRyD1c>.*
"Customer Review," Amazon Product Page For Vadiff Silicone Gas Stove Child Safety Knob Locks.*

* cited by examiner

KNOB SAFETY INSERT

BACKGROUND OF THE INVENTION

Field of the Invention

The present invention relates generally to knob assembly safety and, more particularly, but not by limitation, to knob safety inserts for use on stoves and other similar appliances that comprise knobs that operate with push-turn mechanisms.

Description of Related Art

Current market solutions to the problem of safety of push-turn type of activation knobs of stoves and other similar cooling appliances are primarily focused on the use of knob safety cover which is ineffective in cases where the entire knob control assembly including safety cover can be pushed down far enough to allow turning the cooking element on. In addition, not all knob sizes are supported. Other solution includes the use of removable plastic knob spacers which tend to fall and/or break. Problems of burning, melting, breaking, and scratches to cooking control panels are not uncommon for both solutions, not to mention the children's ease of figuring out how to dismantle the solution.

SUMMARY

This present invention aims to solve the problems mentioned while providing safety, convenience, ease of use and maintenance. Embodiments of the present invention provide a stove knob safety insert that is installed between the rear face of the control knob and the face of the control panel of a cooking appliance. The knob safety insert has one end thicker than the opposite end. In the middle, running from the thick to the thin end is a slot. The slot has an elongated shape, and allows the knob safety insert to be placed onto the switch post and be slidable relative to the switch post while keeping the insert from falling or being uninstalled. Sliding the thicker part of the knob safety insert away from the switch post unlocks the stove knob assembly allowing the cooking element to be turned on or off as desired without uninstalling the knob safety insert.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

It is to be understood that both the foregoing general description and the following detailed description are exemplary and explanatory and are intended to provide further explanation of the invention as claimed.

DETAILED DESCRIPTION OF PREFERRED EMBODIMENTS

Embodiments of the present invention provide a knob safety insert, which is a locking feature for a knob assembly which prevents unintentional movement of a knob away from its "off" (OFF) position while allowing it to be "on" (ON) when desired.

Figure 1:
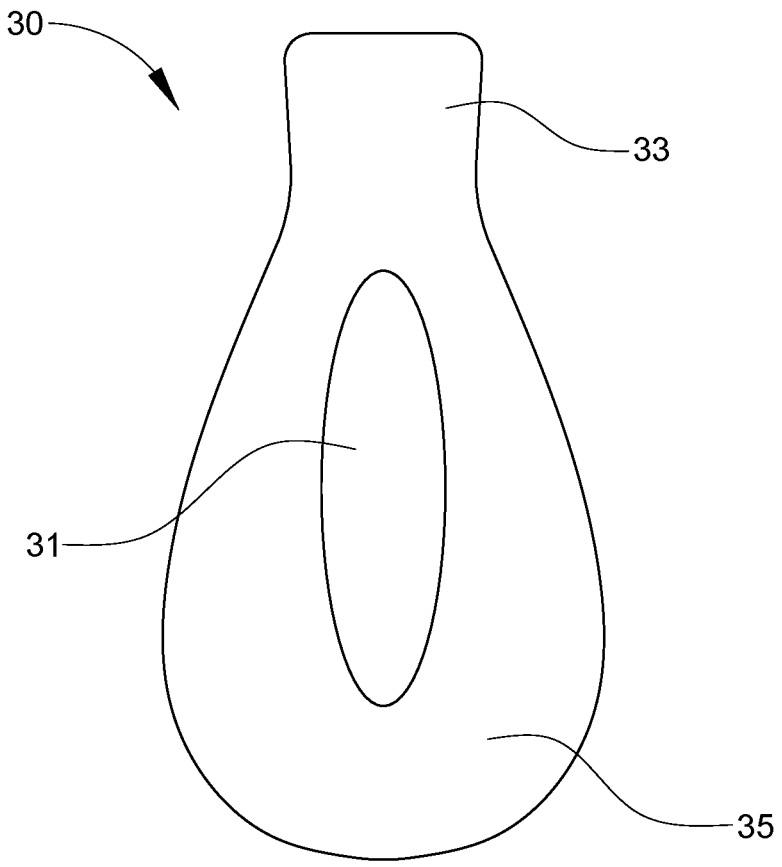
FIG. 1 illustrates a front view of a knob safety insert according to an embodiment of the present invention.

FIG. 1 illustrates an embodiment of the present invention as it applies to cooking appliance safety. The knob safety insert 30 can be installed between the rear face of the control knob and the face of the control panel of a cooking appliance, shown in FIG. 2. The knob safety insert may also be considered a component of a stove knob locking assembly which includes the knob safety insert and the control knob itself. The knob safety insert 30 is generally a plate shape with an elongated slot (opening) 31. The insert has an uneven thickness, where one end 35 is thicker than the opposite end 33. For a cooking application, the thickness depends on the clearance or gap between the knob rear and the face of the control panel. The thin end 33 slides freely behind the knob while the thick end forces the knob from being pushed and turned. The largest thickness of the thick end must be greater than the clearance so as to stop the knob from being pushed far enough to allow the cooking element to be turned on. In some embodiments, the thickness of the insert is approximately between 1.0 mm to 15 mm. The thickness preferably changes gradually (i.e. without abrupt changes) between the thicker end and the thinner end. The thicker end 35 and the thinner end 33 are spaced apart in a longitudinal direction of the insert, and the elongated slot 31 extends in the longitudinal direction between the thicker end and the thinner end. The width of the slot 31 should accommodate the insertion of the knob post 6 and is approximately between 6 mm to 15 mm.

Figure 2:
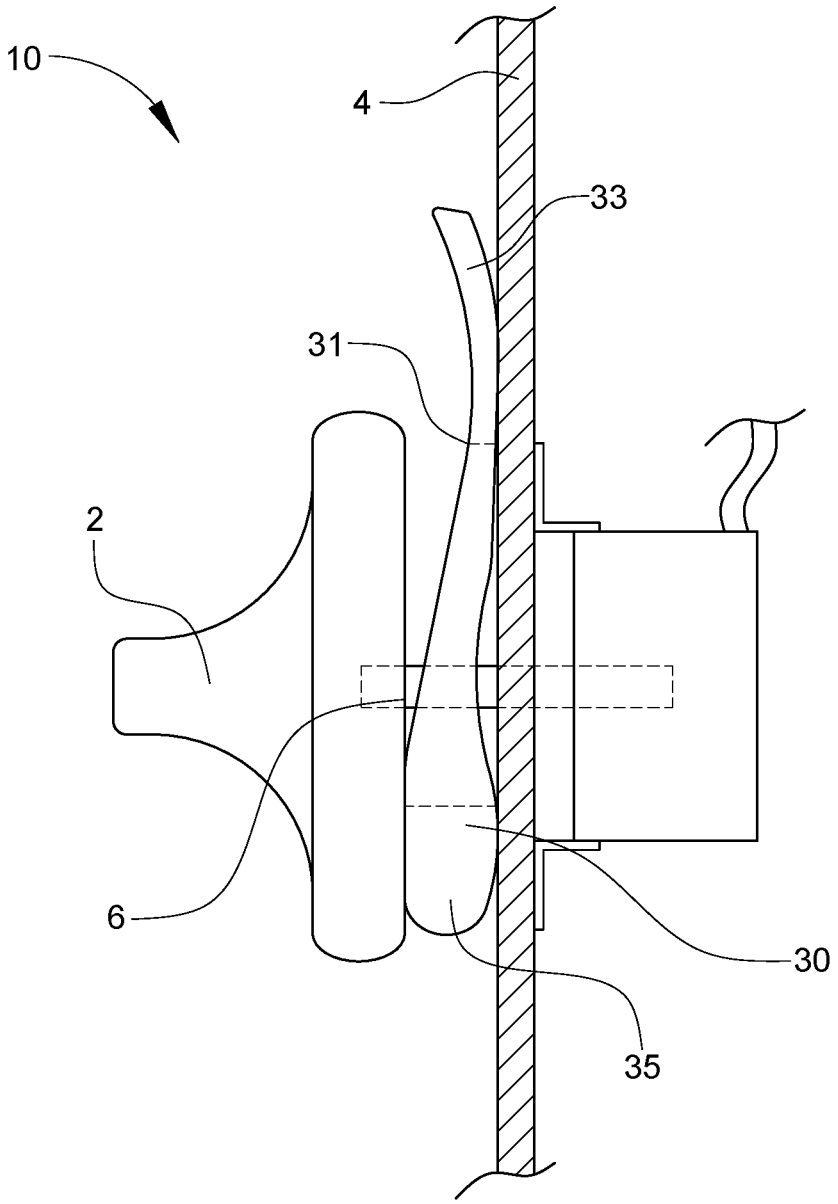
FIG. 2 illustrates a side section view of the knob safety insert of FIG. 1 installed between the rear face of the control knob and the face of the control panel of a cooking appliance, with the knob safety insert in a "locked" position.

To turn ON a typical stove, a user would push then turn a control knob. These motions on the control knob effectively push and turn the switch post which connects to its associated cooking element(s). Turning the control knob to OFF returns the switch post to its original position. FIG. 2 illustrates a side section view of a stove knob locking assembly 10 including the control knob 2 and the knob safety insert 30, with the knob safety insert 30 in a "locked" (LOCK) mode. The LOCK mode as implied herein is the inability of the control knob to be pushed in such a way to enable the switch post to be turned. The knob safety insert 30 is positioned between the rear face of the control knob 2 and the face of the control panel 4. The installation of knob safety insert 30 entails removing the control knob 2 then inserting knob safety insert 30 onto the switch post 6 through slot 31. Replacing the control knob 2 back completes the installation process for the knob locking assembly 10. There is no need to uninstall the knob safety insert except for cleaning.

The slot 31 functions to enable sliding of the knob safety insert 30 along the face of the control panel 4 relative to the switch post 6 to enable LOCK or UNLOCK modes while keeping the knob safety insert 30 attached to the control knob 2. The LOCK mode is enabled by sliding the knob safety insert thick end 35 towards the switch post 6. The UNLOCK mode is enabled by sliding the thin end 33 towards the control post 6; i.e., the thick end 35 away from the control post 6. This allows the control knob 2 to be pushed down far enough to be able to turn the control knob 2 and thus the switch post 6 to turn ON and be able adjust the cooking element. The knob safety insert 30 may be made of a material such as silicone rubber, which can avoid scratching the control panel surface and the knob rear face.

Figure 3:
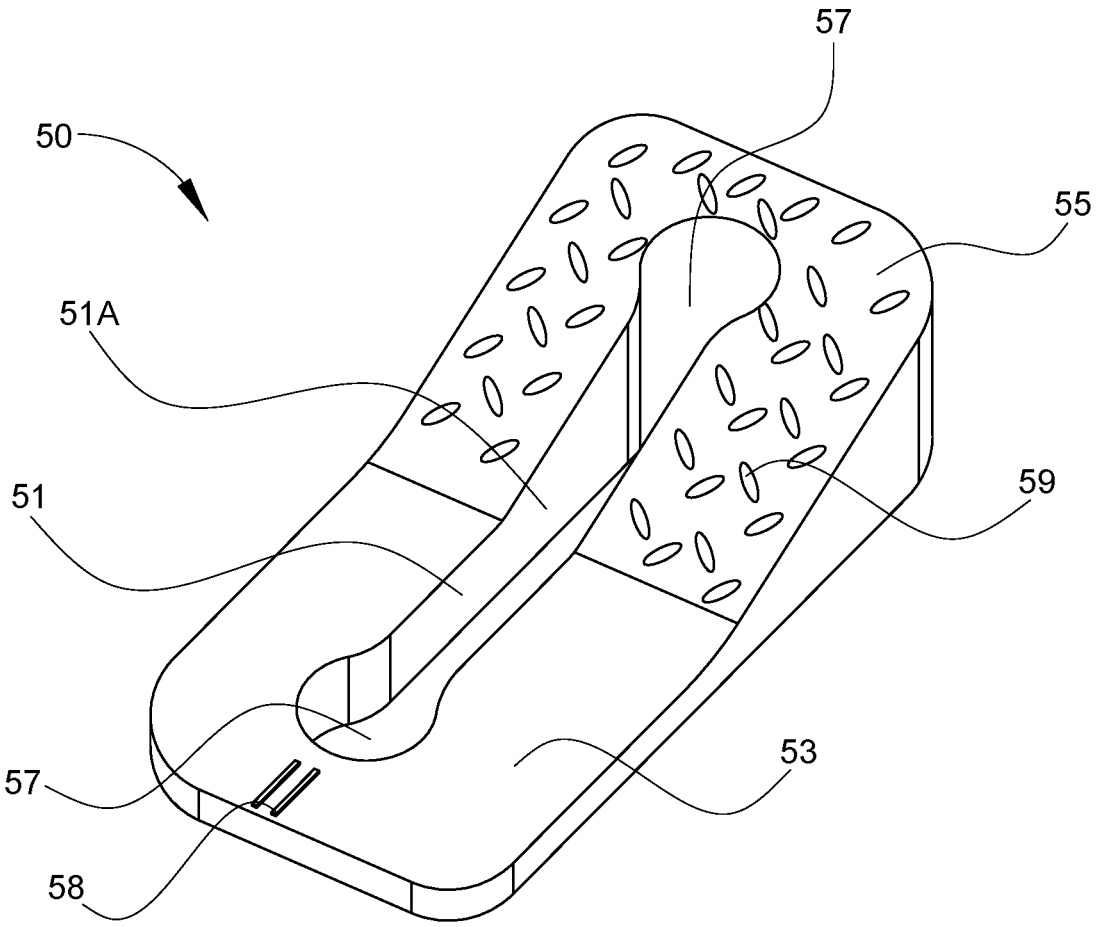
FIG. 3 illustrates an isometric view of a knob safety insert according to another embodiment of the present invention.
Figure 4:
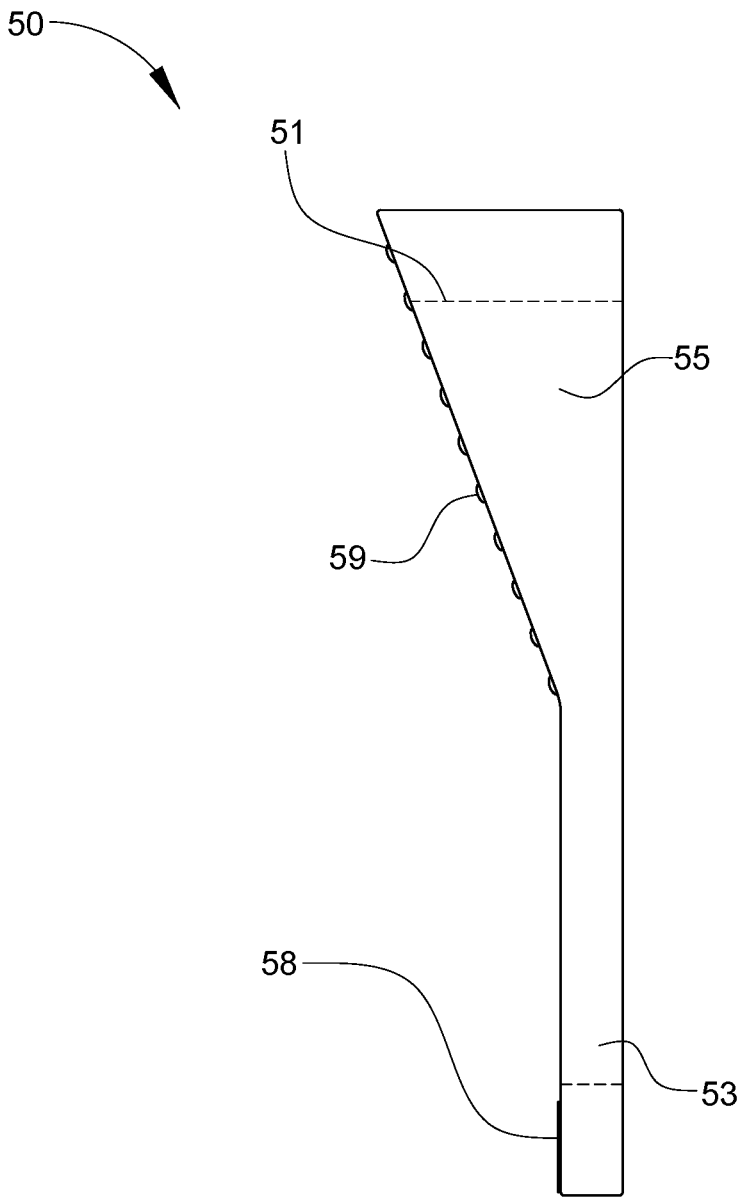
FIG. 4 illustrates a side view of the knob safety insert of FIG. 3.

FIGS. 3 and 4 illustrate a knob safety insert 50 according to a second embodiment of the present invention as it applies to cooking appliance safety. The knob safety insert 50 is similar in installation and use to the knob safety insert 30 of the embodiment shown in FIGS. 1 and 2 with some structural differences. For example, each end of the slot 51 has a "keyhole" shape with a generally round opening (or other shaped) 57 that is wider than the middle section 51A of the slot. The "keyhole" is to allow for easy insertion and rotation of the insert against the knob post. Similar to the knob safety insert 30, knob safety insert 50 has an uneven thickness, where one end 55 is thicker than the opposite end 53. For a cooking application, the thickness on one end 53 is approximately between 1.0 mm to 6 mm while the other end 55 is between 8 mm to 15 mm. In the illustrated embodiment, the thinner end 53 has a substantially uniform thickness, and the thicker end 55 has a wedge shape in the side view. The width of the middle section 51A of the slot 51 is approximately between 6 mm to 12 mm. The diameter (or width) of the holes 57 is approximately at least 2 mm to 10 mm wider than the middle section 51A. The insert 50 may have any suitable length and width, which may be determined based on convenience and aesthetic considerations. For example and without limitation, the length may be 70-90 mm and the width may be 30-50 mm. In this regard, note that FIGS. 3 and 4 are not to scale. In addition, an embossed features 59 are formed the front and/or back surface of the insert to minimize sliding of the knob while in the lock position. The embossed features may be applied to only the thicker end of the knob safety insert 50, or the entire front and/or back surface of knob safety insert.

In the embodiment shown in FIGS. 3 and 4 where the thicker end 55 is a wedge shape, the angle (incline) of the wedge is also a design consideration, as it affects the amount of resistance when pushing the thicker end toward the knob post 6. Note that the largest thickness of the wedge is a function of the angle (incline) of the wedge, the thickness of the thinner end 53 and the length of the wedge. With a fixed angle, the longer the wedge, the greater the thickness at the thickest part. With a fixed angle and fixed length of the wedge, if the thickness of the thinner end 53 increase, the thickness at the thickest end will be greater. Note that the embossed features also affects the amount of resistance when pushing the thicker end toward the knob post 6.

In the embodiments shown in FIGS. 1-4, the length and the two edge locations (in the longitudinal direction) of the slot 31 (or 51) are dependent on the lengths of the insert 30 (or 50) and the length of the thinner end and the thicker end of the insert. Any suitable lengths and edge locations may be used. Preferably, the edges of the slots is approximately 0.3 to 2.0 cm from the corresponding edge of the insert.

The color of the knob safety insert 30 and 50 is preferably black, gray or transparent so as not to catch the attention of children. Use of other colors is an aesthetic choice especially when child-proofing is not a concern.

The preferred material for the knob safety insert 30 and 50 is silicone rubber for its characteristics: heat-resistant, unbreakable, tear-free, moisture-resistant, food-grade, scratch-free. Silicone rubber is generally non-reactive, stable, and resistant to extreme environments and temperatures from −67° F. to 572° F. (−55° C. to 300° C.) while maintaining its useful properties. The silicone rubber used for the knob safety insert 30 and 50 may have any suitable hardness, for example and without limitation, from 45 to 90 Shore A hardness in some embodiments. Other alternative materials are available including plastic and stainless steel but they lack the inherent qualities of silicone rubber needed in this particular application for cooking appliances.

Additional use of these embodiments are to provide warning about the cooking element being ON. When the thick portion of the insert 30 or 50 is showing or located at a different position from the locked mode, it means that the assembly is in UNLOCK mode which could signal that the heating element is left ON and/or the knob lock assembly needs to be set to LOCK mode. Having a bright color for the thicker end of the knob insert such as red (while the rest of the insert is a different color such as black) allows the easy detection of a stove that is left on. This can also be accomplished by incorporating a "glow in the dark" material to the thick portion of the safety insert.

Note that while the front shapes of the knob safety inserts 30 and 50 shown in FIGS. 1 and 3 are elongated shapes, the front shape can generally be any shape, including a round shape. Also note that the thicker end 35 and the thinner end 33 do not have to be the very ends of the insert; more generally, the insert has a thicker portion and a thinner portion spaced apart in the longitudinal direction, where the average thickness of the thicker portion is greater than that of the thinner portion. The thicker and the thinner portions themselves may have uneven thicknesses or even thicknesses. In a middle portion located between the thicker portion and the thinner portion, the thickness of the insert changes gradually. The elongated slot extends between the thicker portion and the thinner portion; it may extend into the thicker portion and/or the thinner portion, or stops short of them.

More generally, the shape and form of the knob insert are only restricted by the space between the knob rear face and control panel face and what fits in the panel without affecting the cooking appliance's functionality. Another embodiment of the present invention is a door-stopper-wedge-like insert with slot along the long edge.

The length of this embodiment of the knob safety insert is such that it is longer than an ordinary control knob without hampering the functionality of the control panel or oven door. A longer size allows the knob safety insert to protrude long enough to be able to push/slide it towards or away from the knob switch post.

Figure 5:
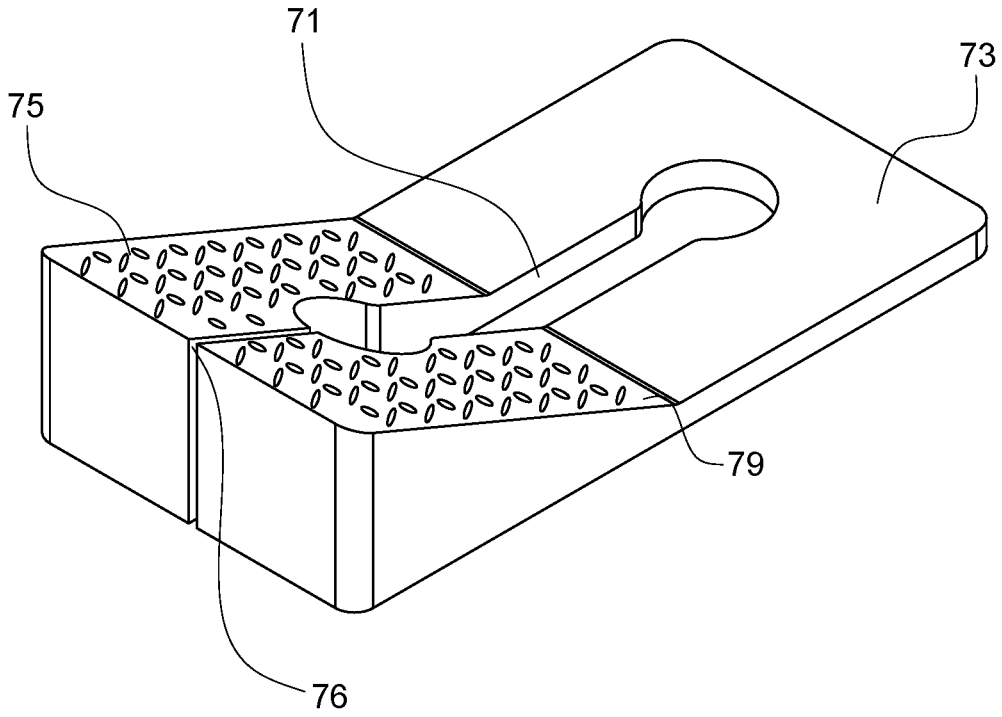
FIG. 5 illustrates an isometric view of a knob safety insert according to yet another embodiment of the present invention.

FIG. 5 illustrates a knob safety insert according to another embodiment of the present invention. Similar to the earlier described embodiments, the knob safety insert shown in FIG. 5 has a thinner end 73 and a thicker end 75, and a slot (opening) 71 extending between the thinner and thicker ends. A through slit 76 is formed, extending from one end of the slot 71 to the corresponding edge of the insert. The through slit should be narrower than the diameter of the switch post 6, but due to the resilient nature of the material of the insert, the user may enlarge the slit to pass the switch post 6 though the slit. This through slit allows for easier installation of the insert in some situations. In the embodiment shown in FIG. 5, the slit 76 is provided at the thicker end of the insert, but it may alternatively be provided at the thinner end of the insert. Such a slit may be useful during installation behind non-removable or hard to remove knobs. In another alternative embodiment, instead of the slit, one or two indicator lines are provided on the knob safety insert to indicate the intended location of the slit, so that the user may cut a slit in the insert using scissors. FIGS. 3 and 4 show two such indicator lines 58, in the form of protruding ridges. Alternatively, the indicator lines may be printed lines on the insert.

The knob safety insert according to embodiments of the present invention aims to prevent toddlers, pets, and adults from activating cooking elements inadvertently while ensuring safety and ease of use.

It will be apparent to those skilled in the art that various modification and variations can be made in the knob safety insert of the present invention without departing from the spirit or scope of the invention. Thus, it is intended that the present invention cover modifications and variations that come within the scope of the appended claims and their equivalents.

What is claimed is:

1. A knob safety insert device for a push-turn switch knob, comprising a plate shaped member, the plate shaped member having a first portion with a first average thickness and a second portion with a second average thickness greater than the first average thickness, the first portion and the second portion being spaced apart in a longitudinal direction, the plate shaped member defining an elongated slot extending in the longitudinal direction between the first portion and the second portion, the slot having two round sections and a middle section connected to the two round sections, each of the two round sections having a diameter that is larger than a width of the middle section, the plate shaped member further defining a through slit extending from an interior of the elongated slot through the plate shaped member to an outer edge of the plate shaped member, the through slit having a width that is smaller than the width of the middle section.

2. The knob safety insert device of claim 1, wherein the first and second average thicknesses of the plate shaped member are between 1.0 mm to 15 mm.

3. The knob safety insert device of claim 1, wherein the first average thickness is between 1.0 mm to 6 mm and the second average thickness is between 8 mm to 15 mm.

4. The knob safety insert device of claim 1, wherein the plate shaped member further has a middle portion located between the first portion and the second portion, wherein a thickness of the middle portion changes gradually.

5. The knob safety insert device of claim 1, wherein the width of the middle section is between 6 mm to 12 mm and the diameter of each of the round sections is between 2 mm to 10 mm wider than the width of the middle section.

6. The knob safety insert device of claim 1, wherein the plate shaped member is made of silicone rubber.

7. The knob safety insert device of claim 1, wherein a front surface and/or a back surface of the plate shaped member includes embossed features.

8. The knob safety insert device of claim 1, wherein the second portion or a portion of the plate shaped member adjacent to the second portion has a color different from a color of at least the first portion of the plate shaped member.

* * * * *